United States Patent [19]

Juillard

[11] Patent Number: 4,569,374

[45] Date of Patent: Feb. 11, 1986

[54] DEVICE FOR STOPPING THE CLOTH TAKEUP REGULATOR IN A WEAVING LOOM

[75] Inventor: Yves Juillard, Mulhouse, France

[73] Assignee: Societe Alsacienne de Construction de Materiel Textile, Mulhouse, France

[21] Appl. No.: 588,704

[22] Filed: Mar. 12, 1984

[30] Foreign Application Priority Data

Mar. 16, 1983 [FR] France ..... 83 04295

[51] Int. Cl.[4] ..... D03D 49/20

[52] U.S. Cl. ..... 139/304; 139/309

[58] Field of Search ..... 139/304, 105, 309, 310, 139/315, 340, 339; 66/149 R, 151; 242/67.1 R; 192/18 R, 18 B, 4 R

[56] References Cited

U.S. PATENT DOCUMENTS 3,969,178 7/1976 Jeanson ..... 242/67.1 R
4,122,652 10/1978 Holtermann ..... 192/18 R
4,227,554 10/1980 Volland ..... 139/310

FOREIGN PATENT DOCUMENTS 962357 9/1982 U.S.S.R. ..... 139/105

*Primary Examiner*—Henry S. Jaudon
*Assistant Examiner*—Steve Shongut
*Attorney, Agent, or Firm*—Holman & Stern

[57] ABSTRACT

A cam-following roller is brought by a low-power electromagnet into contact with a cam carried by a driving pulley. A second roller which is coaxial with the follower roller exerts a thrust on a disk when the follower roller travels along the profile of the cam, thus disengaging the pulley from the driving shaft of the cloth takeup regulator.

11 Claims, 5 Drawing Figures

DEVICE FOR STOPPING THE CLOTH TAKEUP REGULATOR IN A WEAVING LOOM

BACKGROUND OF THE INVENTION

1. Field of the Invention

This invention relates to the cloth takeup regulator of a weaving loom and in particular to a device for releasing and stopping the cloth takeup motion at least during one weft shot or pick while the loom is running.

2. Description of the Prior Art

It is already a known practice to make use of devices for periodically stopping the forward motion of the fabric in order to obtain blows of the slay with intermittent takeup motion, especially for one cycle of the loom out of two. Thus, during each alternate cycle, the weft thread is beaten-up by the read without previously advancing the cloth over a distance corresponding to one weaving cycle of the loom.

In these known devices, an actuating member usually consisting of an electromagnet which is excited periodically initiates disengagement of a clutch-type coupling system interposed in the kinematic transmission chain which drives the cloth takeup roller and produces a braking action on the regulator. However, this electromagnet is required to produce action on parts under load and to exert a high disengagement and braking force which is produced by the electromagnet. In consequence, the electromagnet has to be of large size, is therefore costly and has an appreciable power consumption.

BRIEF SUMMARY OF THE INVENTION

The present invention proposes to overcome this disadvantage by means of a device for stopping the cloth takeup regulator under the control of an actuating device and especially a low-power electromagnet, the greater part of the effort required for disengagement and braking of the regulator being supplied by the driving force of the regulator itself.

The object of the invention is to provide a device for stopping the cloth takeup regulator in a weaving loom in order to selectively connect and disconnect a rotary driving member with respect to the driving shaft of the cloth takeup regulator under the control of an actuating device. When it is put into operation, said actuating device causes the displacement of a coupling member toward a position in which it disconnects the driving shaft from the driving member. In accordance with the invention, the device comprises a cam rigidly fixed to the driving member, and a cam-following roller maintained by a movable roller support away from the path of travel of the cam profile in a rest position of said roller. A first mechanical connection system is interposed between the actuating device and the roller so as to bring said roller into an active position on the path of travel of the cam profile when said actuating device comes into operation. A second mechanical connection system is interposed between said roller support and said coupling member in order to displace said member toward the disconnected position. The result thereby achieved is that the force required for displacement of said coupling member is produced by the driving member via the cam, the roller and the second mechanical connection system and not by the actuating device.

In a preferred embodiment of the invention, the actuating device is constituted by an electromagnet and the cam has the shape of a bell formed on the lateral face of the rim of a pulley. The pulley constitutes the driving member and is driven for example by a belt in synchronism with the main shaft of the loom, said pulley being mounted to rotate freely on the driving shaft.

Preferably, the coupling member comprises a sleeve which is slidably mounted and locked rotationally on the driving shaft. Said sleeve is provided on the one hand with coupling lugs which are capable of cooperating with corresponding recesses formed in the hub of the pulley and on the other hand with a disk or plate with which a second roller is adapted to cooperate and constitutes the second mechanical connection system aforesaid. Said second roller undergoes a movement of axial displacement in the same manner as the first roller when said first roller travels along the cam profile in order to separate the coupling sleeve from the pulley.

Preferably, means for producing a braking action on the driving shaft are provided in conjunction with the disconnecting system.

The invention is also directed to weaving looms equipped with a device of this type for stopping a cloth takeup regulator.

BRIEF DESCRIPTION OF THE DRAWINGS

Other features of the invention will be more apparent upon consideration of the following detailed description with reference to the accompanying drawings, wherein.

DETAILED DESCRIPTION

Figure 1:
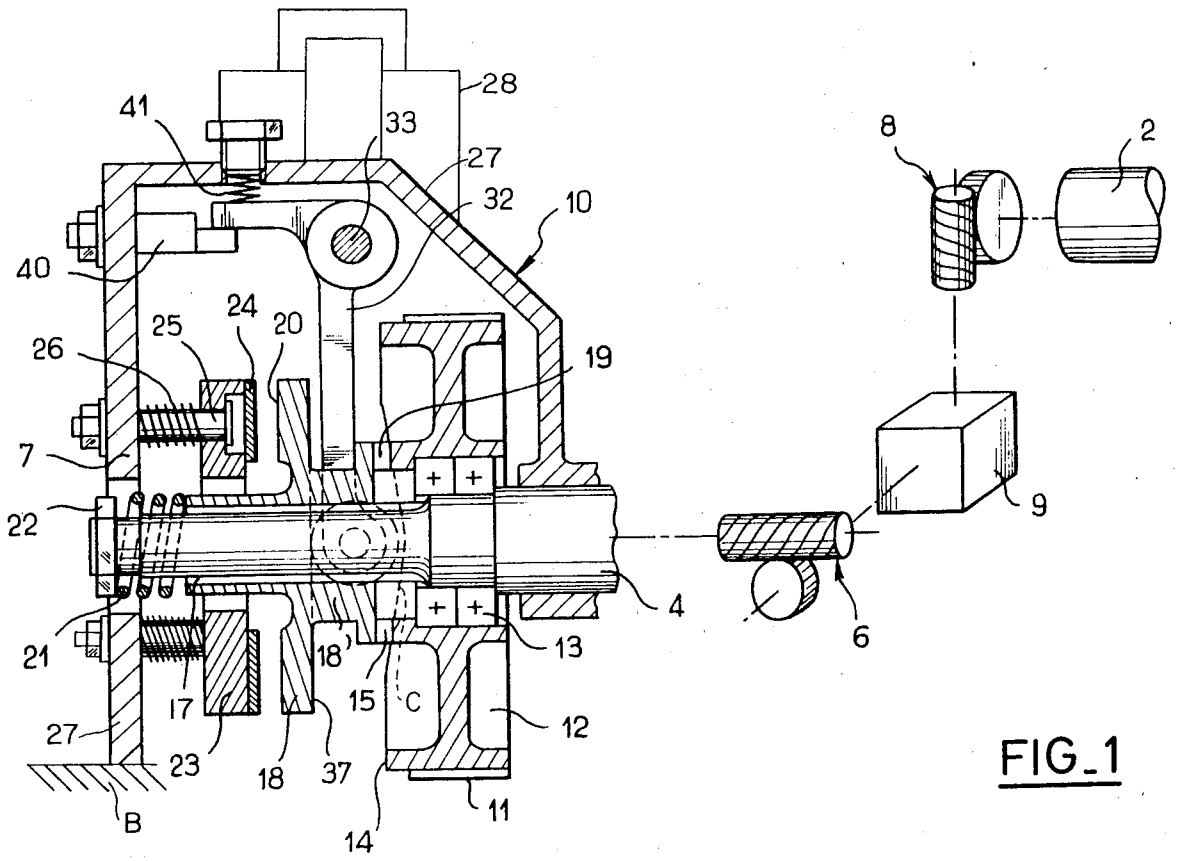
FIG. 1 is a longitudinal cross sectional view taken along the axis of the driving shaft and showing the device in accordance with the invention.

The cloth takeup roller 2 is driven from a driving shaft 4 via the kinematic chain of the takeup regulator which can comprise a first worm and worm gear pair 6, a second worm and worm gear pair 8, and a reduction-gear unit 9 providing a variable gear ratio in accordance with known practice.

The device 10 for stopping the regulator has the design function of selectively connecting or disconnecting the driving shaft 4 with respect to driving means constituted in the example shown by a belt 11 or by any other suitable power transmission system connected to the main shaft of the loom.

Figure 3:
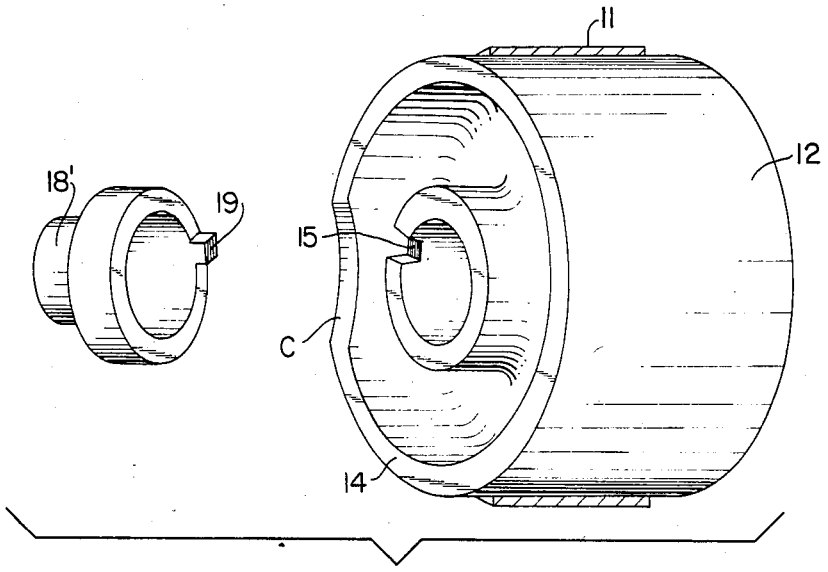
FIG. 3 is a fragmentary perspective view of the pulley and sleeve in the disengaged position.

The belt 11 drives a pulley 12 which is mounted to rotate freely on the shaft 4 by means of a ballbearing 13. One side of the rim of the pulley 12 is designed in the form of a cam 14 shown more clearly in FIG. 3. The pulley 12 is provided on one side of the hub with a plurality of recesses 15 shown more clearly in FIGS. 1*a* and 3. The end of the shaft 4 is provided with splines 17 on which a disk 18 is engaged by sliding. Said disk 18 is rigidly fixed to a sleeve 18' which is adapted to carry one or a plurality of lugs 19 shown more clearly in FIGS. 1*a* and 3 which engage within the recesses 15 of the pulley 12, thus interlocking the shaft 4 and the pulley. The disk 18 and its face 20 also serve to produce a braking action. A spring 21 is fitted over the splines 17 of the driving shaft 4 and, under the thrust exerted by an adjusting nut 22, maintains the recesses and lugs 15, 19 in the interengaged position. A disk 23 with a brake lining 24 forms the counter-disk of the brake. Said counter-disk is slidably mounted on at least three pins 25, mounted in frame 27 at 120° with respect to each other, together with a corresponding number of springs 26 on the pins interposed between the counter disk 23 and the frame 27 of the device 10. "The frame 27 is mounted on the body or frame of the loom shown schematically at B in FIG. 1.

A low-power electromagnet 28, mounted on frame 27 and having lead wires E for connecting to an electric power source, is provided with a ball-tipped operating rod 29 so as to exert a push or a thrust on an arm 30*a* of a slide-lever 30 mounted on a fulcrum-pin 31 which is rigidly fixed to a rocker 32, said rocker being in turn freely mounted on a shaft 33 which is mounted to the frame 27. The lower portion of the rocker 32 forms a fork 34 traversed by a shaft 35 which carries a roller 36. Said roller rests against the rear face 37 of the disk 18. A second cam following roller 38 and a spring 39 which maintains a predetermined spacing between the rollers 36, 38 is also fitted over the shaft 35.

When a signal is transmitted to the electromagnet, this latter exerts a thrust on the arm 30*a* of the slide-lever 30. A second lever-arm 30*b* in the form of a fork transmits the motion received to the cam following roller 38 which is displaced along its shaft 35 over the distance necessary to come into position against the cam-type rim 14 of the pulley 12 which, as it continues to rotate, displaces the roller 38 and the rocker 32. At the same time, the roller 36 which is also fitted over the shaft 35 rests on the rear face 37 of the disk 18 undergoes a displacement over the same distance as the roller 38 and produces a movement of relative disengagement between the pulley 12 and the disk 18 by reason of the separation of the lugs 19 from the recesses 15. At the moment of disengagement of the disk 18, the face 20 of said disk comes into contact with the disk 23 and the brake lining 24. The disk 23 which is mounted on the pins 25 and the springs 26 is caused by the travel of the rocker 32 to undergo a movement of displacement in order to guarantee efficient braking of the driving shaft 4.

The pulley 12 is then no longer connected to the driving shaft 4 and thus rotates freely on its bearings whilst the disengaged and braked shaft 4 comes to a standstill, whereupon the takeup roller 2 also stops and the cloth no longer moves forward.

An adjustment-eccentric stop 40 is provided for establishing the rest position of the rocker 32 and reducing to zero the clearance between the roller 36 and the rear face 37 of the disk 18. An adjustable restoring spring 41 provides assistance in returning the rocker 32 against its stop 40.

Figure 4:
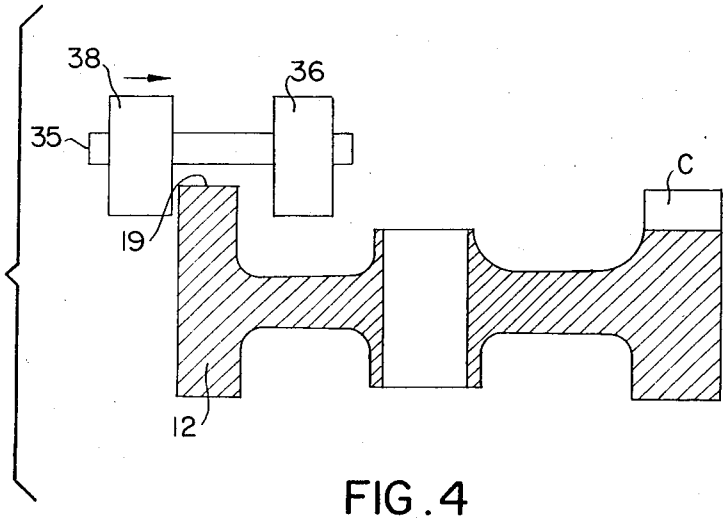
FIG. 4 is a fragmentary cross-sectional view of the pulley showing another feature of the invention.

It is readily apparent from the foregoing that the electromagnet 28 only has to develop the force which is necessary in order to displace the cam following roller 38 in opposition to the spring 39 and to bring said roller opposite to the cam-type rim 14 of the pulley 12. When the signal for energizing the electromagnet 28 has been produced by a conventional synchronization system and as soon as the hollow or concave portion of the cam, shown in dash line in FIG. 1 and more clearly at C in FIG. 3, moves into position in front of the cam following roller 38, the electromagnet only has to overcome low friction and inertia forces. As shown in FIG. 4, which is a view along a plane perpendicular to the plane of FIG. 2, the cam following roller 38 is outside of the cam-shaped rim 14. When solenoid 28 is energized, lever 30*b* moves cam follower roller 38 to the right, as viewed in FIGS. 2 and 4, into engageable position with cam 14. The cam follower roller may engage the planar side of pulley 12 for a brief period until with rotation of pulley 12 the concave portion C is adjacent cam follower roller 38 at which time the latter moves further to the right into the fully engaged position with the cam surface, which thereafter pushes the cam follower roller to the left as viewed in FIG. 1.

Figure 1A:
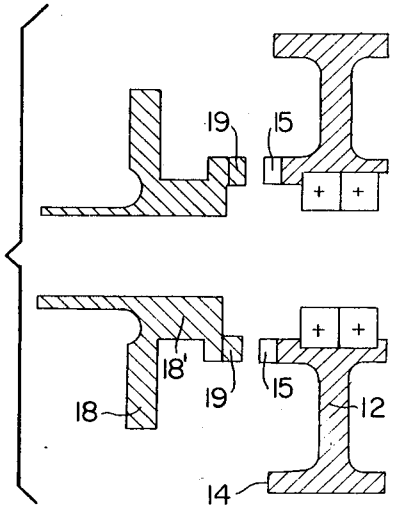
FIG. 1*a* is a fragmentary view of the pulley and sleeve in the disengaged position.

Once the cam following roller 38 has engaged with the cam 14, the effort required for disconnecting the lugs and recesses 15 and 19 under load and for applying the disk 18 against the brake lining 24 is supplied only by the driving pulley 12 which moves cam follower roller 38, rocker 32 and roller 3*b* counterclockwise about the axis of shaft 33 as viewed in FIG. 1 thereby disengaging lugs 19 from recesses 15.

In the event that the pulley 12 performs one revolution er cycle of the loom, the cam 14 is provided with only one hollow zone C. In consequence, the cam following roller 38 is located opposite to the hollow portion of the cam after one revolution of the pulley 12 in the disconnected and braked position. This enables the rocker 32 to return to its initial position shown in FIG. 1 in which the disk 18 moves away from the brake lining 24 and in which the recesses and lugs 18, 19 again engage in order to couple the pulley 12 to the driving shaft 4.

Figure 2:
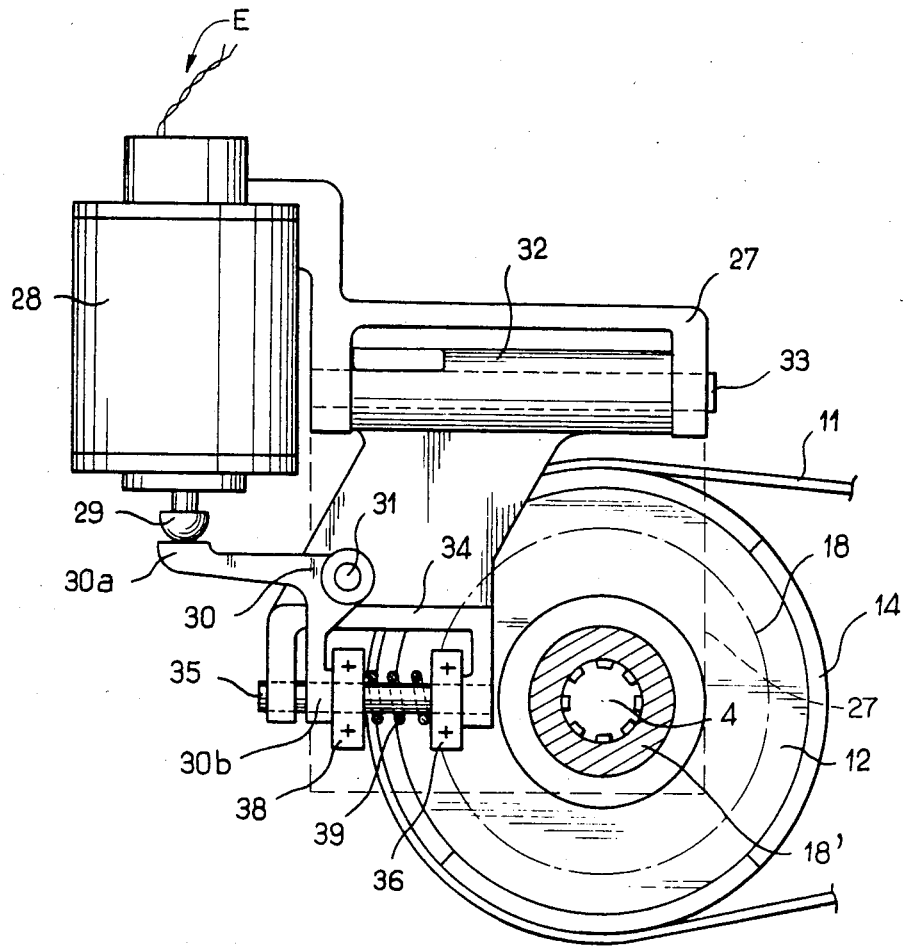
FIG. 2 is a side view of the same device with the actuating electromagnet in the rest position.

At the same time, since the electromagnet 28 is no longer energized, the cam following roller 38 which is thrust back by its spring 39 returns to its initial position away from the path of travel of the cam 14 as shown in FIG. 2. In consequence, until a further excitation of the electromagnet 28, the cloth takeup roller is normally driven by the regulator.

In the foregoing description which has been given with reference to FIGS. 1 and 2, consideration has been given to the preferred embodiment of the invention in which the cam 14 is constituted by the rim of a driving pulley 12 or of any other rotary driving member such as a toothed wheel or a chain wheel. The bell-type cam thus formed is particularly well-suited to the device in accordance with the invention since the displacements of the cam-following roller are parallel to the axis of rotation of the cam or in other words parallel to the direction in which the movable coupling and braking member (disk 18 and coupling recesses 19) is intended to be displaced. The connection system between the cam-following roller 38 and the coupling member to be displaced is thus considerably simplified and even practically dispensed with since it is reduced to the addition of the roller 36.

As can readily be understood, however, it would not constitute any departure from the scope of the invention to employ a cam other than the bell type contemplated in the foregoing. It would thus be possible, for example, to adopt a flat cam having a hollow portion of profile in which a cam-following roller would engage in response to excitation of the electromagnet.

Provision would be made in this case for a connection system adapted to conversion of motion in order to convert the radial displacements of the cam-following roller to axial displacements of the movable coupling and braking member. Again in this case, however, the force required for disengagement and braking would be supplied by the driven member which carries the cam, with the result that the actuating electromagnet develops only low power.

There has been described in the foregoing a device in which the displacement of the roller 38 is controlled by an electromagnet since this is the most common solution. It is clearly possible, however, to bring the cam following roller 38 into contact with the cam 14 by means of any other actuating device which will be required to develop much lower power than similar actuating devices of known regulator-stopping mechanisms employed up to the present time.

From this it follows that the roller-actuating device could consist, for example, of a low-power hydraulic or pneumatic jack or a cable.

I claim:

1. A device for stopping the cloth takeup regulator in a weaving loom in order to selectively connect and disconnect a rotary driving member with respect to the driving shaft of the cloth takeup regulator under the control of an actuating device which is energized so as to cause the displacement of a coupling member toward a position in which it disconnects the driving shaft from the driving member, wherein said device comprises a cam having a cam profile; rigidly fixed to the driving member, a cam-following roller maintained by a movable roller support away from the path of travel of the cam profile in a rest position of said roller, a first mechanical connection system interposed between the actuating device and the roller so as to bring said roller into an active position on the path of travel of the cam profile when said actuating device comes into operation, and a second mechanical connection system interposed between said roller support and said coupling member in order to displace said coupling member toward the disconnected position with the result that the force required for displacement of said coupling member is produced by the driving member via the cam, the roller and the second mechanical connection system and not by said actuating device.

2. A device according to claim 1, wherein the actuating device comprises an electromagnet.

3. A device according to claim 2, wherein the cam is designed in the form of a bell, the axis of rotation of which is the axis of the driving shaft.

4. A device according to claim 1, wherein the cam is designed in the form of a bell, the axis of rotation of which is the axis of the driving shaft.

5. A device according to claim 4, wherein the rotary driving member comprises a pulley which is driven in synchronism with the main shaft of the loom, said pulley being mounted to rotate freely on the driving shaft, and wherein the bell-type cam is formed by the edge of the rim of said pulley.

6. A device according to claim 5, wherein the coupling member comprises a sleeve slidably mounted and locked rotationally on the driving shaft, said sleeve being provided on the one hand with at least one coupling lug which is capable of cooperating with at least one corresponding recess formed in the hub of the pulley and on the other hand with a disk having a flat face directed towards said cam, and wherein said sleeve is urged by a spring toward the position of interengagement of said lugs and recesses.

7. A device according to claim 6, wherein the cam-following roller is rotatably and slidably mounted on a shaft carried by a supporting rocker pivotally mounted on a stationary shaft, and wherein the second mechanical connection system comprises a roller freely mounted on said shaft and having a peripheral surface located opposite to the flat face of said disk.

8. A device according to claim 7, wherein the coupling member is adapted to cooperate with a stationary braking element in the disengaged position of said coupling member.

9. A device according to claim 8, wherein said device comprises an annular braking member located on the side nearest the disk face opposite to the flat face, said annular braking member being stationarily mounted around the driving shaft and adapted to carry a brake lining against which is applied said opposite disk face when the coupling member undergoes a displacement toward its disengaged position.

10. A device according to claim 9, wherein the annular braking member is supported by the frame of the device with interposition of springs which permit axial displacement of said annular braking member.

11. A device according to claim 10, wherein said device comprises a spring interposed on the shaft between the two rollers for restoring the cam-following roller to the rest position.

* * * * *